US007731103B2

(12) United States Patent
Amron

(10) Patent No.: US 7,731,103 B2
(45) **Date of Patent: *Jun. 8, 2010**

(54) FLOWABLE PRODUCT DISPENSING TOY AND METHODS OF USING THE SAME

(75) Inventor: Alan B. Amron, Brooklyn, NY (US)

(73) Assignee: Tropical Ventures LLC, Woodbury, NY (US)

( * ) Notice: Subject to any disclaimer, the term of this patent is extended or adjusted under 35 U.S.C. 154(b) by 888 days.

This patent is subject to a terminal disclaimer.

(21) Appl. No.: 11/237,424

(22) Filed: Sep. 28, 2005

(65) Prior Publication Data

US 2007/0068963 A1 Mar. 29, 2007

Related U.S. Application Data

(63) Continuation-in-part of application No. 11/230,143, filed on Sep. 19, 2005, now Pat. No. 7,374,069.

(51) Int. Cl.
*B05B 3/04* (2006.01)

(52) U.S. Cl. ..... 239/237; 222/205; 222/206; 222/215; 239/383; 239/381; 239/223

(58) Field of Classification Search ..... 239/225.1, 239/226, 232, 231, 233, 251, 265.11, 380, 239/382, 383, 389, 381, 227, 263, 526; 222/410, 222/215, 206, 201, 537, 205, 211, 438, 207, 222/204

See application file for complete search history.

(56) References Cited

U.S. PATENT DOCUMENTS

| | | | | |
|---|---|---|---|---|
| 1,150,940 | A | | 8/1915 | Irish |
| 1,798,488 | A | | 3/1931 | Orr |
| 1,941,786 | A | | 1/1934 | Carley et al. |
| 2,381,740 | A | | 8/1945 | Grelson |
| 2,794,292 | A | | 6/1957 | Noble |
| 2,830,739 | A | | 4/1958 | Moye |
| 2,998,166 | A | | 8/1961 | Klawiter |
| 3,399,638 | A | | 9/1968 | Bishop et al. |
| 3,493,179 | A | * | 2/1970 | Lee ..... 239/327 |
| 3,556,689 | A | | 1/1971 | Heckler, IV |
| 3,628,700 | A | * | 12/1971 | Dodoghue ..... 222/187 |
| 3,804,336 | A | | 4/1974 | Koppe |
| 4,286,736 | A | | 9/1981 | Corsette |

(Continued)

*Primary Examiner*—Len Tran
*Assistant Examiner*—Trevor E McGraw
(74) *Attorney, Agent, or Firm*—Cohen Pontani Lieberman & Pavane LLP

(57) ABSTRACT

A dispensing system for dispensing a viscous, flowable product such, for example, as a spin-art paint solution, comprises an axially extending container that defines an opening and an interior chamber for receiving and storing the flowable product. A discharge assembly is coupled to the container, the discharge assembly being dimensioned and arranged to spin, relative to the container, as it receives the flowable product from the interior chamber. The spinning motion of the discharge assembly, which may be accompanied by a linear movement of the container itself relative to a target surface, allows the user to cleanly and evenly distribute the flowable material onto a target substrate in an attractive, curvilinear deposit pattern. Optionally, the discharge assembly may be configured with a pivoting nozzle that can be moved from a position for obtaining a helical (curvilinear) deposit pattern to a position for obtaining a rectilinear deposit pattern.

16 Claims, 2 Drawing Sheets

U.S. PATENT DOCUMENTS 4,335,677 A 6/1982 Nagata
4,397,879 A 8/1983 Wilson
4,542,853 A 9/1985 Diamond
4,615,488 A 10/1986 Sands
4,709,691 A 12/1987 Lemons et al.
4,821,961 A 4/1989 Shook
4,838,490 A 6/1989 Nissels
4,842,200 A 6/1989 Hermansson
4,989,786 A 2/1991 Kranzle et al.
5,024,382 A 6/1991 Shook et al.
5,060,863 A 10/1991 Hammelmann
5,086,974 A 2/1992 Henshaw
5,104,043 A 4/1992 Pacht
5,119,971 A * 6/1992 Reyman ..... 222/129
5,127,553 A * 7/1992 Weinstein ..... 222/158
5,224,652 A 7/1993 Kessler
5,244,153 A 9/1993 Kuhn et al.
5,297,979 A 3/1994 Amron
5,392,968 A 2/1995 Dark
5,395,053 A * 3/1995 Frech ..... 239/227
5,427,320 A 6/1995 Mak et al.
5,433,646 A 7/1995 Tarng
5,456,413 A 10/1995 Ellis
5,492,275 A 2/1996 Crampton
5,505,380 A 4/1996 Jun
5,577,945 A 11/1996 La Belle
5,582,532 A * 12/1996 Tucker ..... 446/475
5,586,688 A 12/1996 Johnson et al.
5,595,345 A 1/1997 Chura
5,667,138 A 9/1997 Crampton
5,674,323 A 10/1997 Garcia
5,725,680 A 3/1998 Mathieus
5,740,964 A 4/1998 Crampton
5,826,750 A 10/1998 Johnson
5,833,124 A * 11/1998 Groves et al. ..... 222/158
5,865,344 A 2/1999 Nagel
5,878,914 A 3/1999 Johnson
6,007,003 A 12/1999 Wang
6,129,293 A 10/2000 Jaeger
6,151,824 A 11/2000 Clayton
6,155,494 A * 12/2000 Fabbri et al. ..... 239/240
6,186,367 B1 * 2/2001 Harrold ..... 222/205
6,196,475 B1 * 3/2001 Jaeger ..... 239/381
6,199,771 B1 3/2001 Clearman et al.
6,217,245 B1 * 4/2001 El-Fakir et al. ..... 401/195
6,250,506 B1 6/2001 Geiger et al.
6,330,960 B1 * 12/2001 Faughey et al. ..... 222/205
6,331,130 B1 12/2001 Thai
6,364,162 B1 4/2002 Johnson
6,422,480 B1 * 7/2002 Richmond ..... 239/10
6,474,507 B1 11/2002 Hornsby et al.
RE38,077 E 4/2003 Cohen
6,540,108 B1 4/2003 Johnson
6,594,843 B1 7/2003 Wilkins
6,648,244 B2 11/2003 Yu
6,676,037 B2 1/2004 Marks
6,719,218 B2 4/2004 Cool
6,766,967 B2 7/2004 Harris et al.
6,769,631 B2 8/2004 Brown
6,892,902 B2 5/2005 Hornsby
6,899,286 B2 * 5/2005 Blessing ..... 239/225.1
6,935,531 B1 8/2005 Clayton
6,959,838 B2 11/2005 Eddins et al.
7,032,837 B2 4/2006 Eddins et al.
7,097,073 B2 8/2006 Zimmerman
7,111,795 B2 9/2006 Thong
7,131,557 B2 11/2006 Zimmerman et al.
7,182,477 B1 2/2007 Hartz
7,185,787 B2 3/2007 Brown et al.
7,374,069 B2 * 5/2008 Amron ..... 222/410
2001/0019083 A1 9/2001 Marks
2002/0030066 A1 3/2002 McKenna
2002/0090878 A1 7/2002 Holmes
2003/0071141 A1 * 4/2003 Rieben ..... 239/225.1
2003/0085303 A1 * 5/2003 Jaeger ..... 239/380
2004/0164090 A1 8/2004 Eddins et al.
2005/0035148 A1 2/2005 Zimmerman
2005/0173559 A1 8/2005 Eddins et al.
2006/0065760 A1 3/2006 Micheli
2006/0076435 A1 4/2006 Hudson
2006/0261087 A1 11/2006 Amron
2006/0261184 A1 11/2006 Amron

* cited by examiner

FLOWABLE PRODUCT DISPENSING TOY AND METHODS OF USING THE SAME

REFERENCE TO RELATED APPLICATIONS

This application is a continuation-in-part of U.S. patent application Ser. No. 11/230,143 which is now U.S. Pat. No. 7,374,069, filed on Sep. 19, 2005 and entitled Edible Food Product Dispensing System and Methods of Using the Same.

FIELD OF THE INVENTION

The present invention relates generally to the dispensing of viscous material and, more particularly, to the use of a rotatable discharge assistant operative to dispense, from a container such as a squeeze bottle, a viscous material along an arcuate path as the container is moved linearly.

BACKGROUND OF THE INVENTION

Squeeze bottles for storing and dispensing viscous, flowable materials such as food products like syrups, jellies, and condiments, liquid paints used to produce "spin art", and other liquid and/or granular materials such as detergents, cleansers and the like are well known. Generally, such bottles include a container made of a plastic or other easily deformable material and define an interior cavity for receiving and storing the product. The container may further define a neck portion disposed at one end of the container that is attached to a dispensing closure assembly. A typical dispensing closure assembly includes a cap that is threadedly connected to the neck of the container at one end, and has a single outlet tip that faces outwardly from the container at the other end. During use, the container is inverted and squeezed to dispense the viscous product from the tip orifice onto a target surface as a directed stream.

Conventional dispensing closures define an orifice having a circular cross section sized to provide the user with flexibility to apply a desired amount of product to the target surface. A softer squeezing of the container will yield a lower mass flow rate out of the tip. Accordingly, in order to accommodate those who wish to apply only a small amount of material to the target surface, the tips are generally designed with a small cross section. Those who desire an additional amount of material can squeeze harder. In the context of a child's spin art toy environment, the target surface consists of a sheet of paper or other material temporarily secured to a turntable adapted to rotate at a controlled rate. As the sheet rotates, the child squeezes the container and the expelled material moves outwardly through the exertion of centrifugal forces. Although the spin art amusement device continues to enjoy a degree of popularity after several decades, its reliance upon a powered rotary mechanism comes at a considerable cost and complexity.

A need therefore exists for a discharge assistant usable in combination with a conventional container that enables one to apply a sufficient and consistent amount of a flowable material, such as a spin art paint solution, to a target surface.

A further need exists for a spin art amusement system that avoids the cost and complexity of prior art systems.

SUMMARY OF THE INVENTION

The aforementioned need is addressed, and an advance is made in the art, by a dispensing system that is configured to dispense a viscous, flowable product such, for example, as a conventional spin-art paint solution, a condiment, a liquid or granular detergent or other material, and the like. The dispensing system comprises an axially extending container that defines an opening and an interior chamber for receiving and storing the flowable product. A discharge assembly is coupled to the container, the discharge assembly being dimensioned and arranged to spin, relative to the container, as it receives the product from the interior chamber. The spinning motion of the discharge assembly, accompanied by a linear movement of the container itself relative to a target surface, allows the user to distribute the flowable material onto a target surface in an attractive, helical (or more broadly speaking, curvilinear) deposit pattern.

An illustrative embodiment of the discharge assembly includes a first section defining an interior cavity, the first section also defining both an inlet opening dimensioned and arranged to establish fluid communication between the interior cavity and the interior chamber, and an outlet opening dimensioned and arranged to allow food product flowing under pressure to exit the interior cavity as a stream as said first section spins.

A spin-art amusement system configuration constructed in accordance with the present invention includes a tray dimensioned and arranged to receive and retain a suitable target surface, such as a sheet of paper or other substrate, and further comprises a dispensing system constructed in accordance with the present invention and containing a commercial painting solution. As will be readily appreciated by those skilled in the art, it is a discharge opening of the dispensing system, rather than the paint-receiving substrate, that is rotated during use. The effect is unique, aesthetically pleasing, and is produced without the cumbersome electrically motorized drive system associated with prior art systems. In a typical configuration, a squeeze bottle is employed as the container. By squeezing the deformable sidewall of the container, the paint solution flows from the interior chamber into the interior cavity of the discharge assembly. In accordance with an especially preferred embodiment of the invention, the same squeezing force which causes the material to flow is also used to produce rotary motion of the discharge assembly. To this end, the discharge assembly may include a plurality of vanes disposed within the interior cavity, the vanes being dimensioned and arranged to convert energy imparted by flowing flowable product impinging thereon into forces driving rotary motion of the discharge assembly.

The discharge assembly may be further configured with a pivotably movable nozzle member having a distal section defining a nozzle orifice and having a substantially spherical proximal section retained in fluid communication with the outlet opening, whereby a user can control at least one of a diameter and a pitch of said helical deposit pattern by selecting an appropriate angular position of the nozzle member. The location of the nozzle member may be offset relative to a central axis of rotation of the discharge assembly. Alternatively, the nozzle member may be positioned coaxially with the central axis of rotation, the latter configuration having the advantage of permitting the user to select between an angled orientation suited for producing helical deposit patterns on a target surface and a non-pivoted orientation which enables the consumer to direct the flow along a rectilinear deposit path.

BRIEF DESCRIPTION OF THE DRAWINGS

The details of the present invention, both as to its construction and operation can best be understood with reference to the accompanying drawings, in which like numerals refer to like parts, and in which.

DETAILED DESCRIPTION OF THE INVENTION

Figure 1:
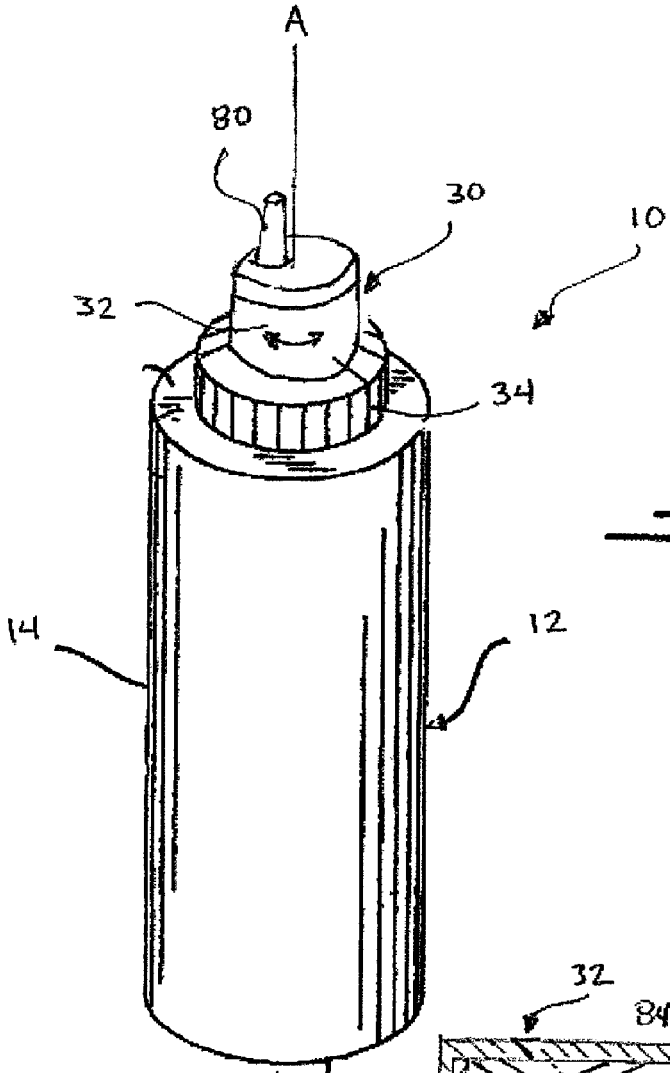
FIG. 1 is a side elevation view depicting a flowable product dispensing system in accordance with an illustrative squeeze bottle embodiment of the present invention, the system being equipped with a discharge assembly adapted to rotate automatically, as the flowing material is discharged, to produce a helical deposit pattern.

The accompanying Figures and this description depict and describe embodiments of a discharge assistant adapted for use with a conventional container in accordance with the present invention, and features and components thereof. The present invention also encompasses a method of making and using embodiments of the discharge assistant. As used herein, the phrases or terms "discharge assistant," "dispensing closure assembly," "discharge assembly" and the like are intended to encompass a structure or structures configured to dispense a flowable, viscous material such, for example, as a spin art paint solution, onto a target surface in a manner other than as a continuous rectilinear ("straight-line") deposit pattern or as a series of brief pulses. It is important to note, however, that viscous flowable product dispensing systems in accordance with the present invention can, if an optional mode of operation is desired, be configured to dispense product in a continuous or broken rectilinear deposit pattern if the consumer so selects. It should also be noted that any references herein to front and back, right and left, top and bottom and upper and lower are intended for convenience of description, not to limit the present invention or its components to any one positional or spacial orientation.

With regard to fastening, mounting, attaching or connecting components of the present invention to form the dispensing system as a whole, unless specifically described otherwise, such are intended to encompass conventional fasteners such as threaded connectors, snap rings, detent arrangements, pins and the like. Components may also be connected by adhesives, glues, welding, ultrasonic welding, and friction fitting or deformation, if appropriate, and appropriate liquid and/or airtight seals or sealing devices may be used. Electronic portions of the device may use conventional, commercially available electronic components, connectors and devices such as suitable wiring, connectors, printed circuit boards, microchips, pressure sensors, liquid level sensors, inputs, outputs and the like. Unless specifically otherwise disclosed or taught, materials for making components of the present invention may be selected from appropriate materials such as metal, metallic alloys, natural and man-made fibers, vinyls, plastics and the like, and appropriate manufacturing or production methods including casting, pressing, extruding, molding and machining may be used.

With regard to the manner in which viscous material is urged to flow toward a discharge opening, it should be borne in mind that although the various embodiments described herein incorporate a squeeze bottle configuration in which material flows when a deformable sidewall of a flexible container is squeezed, the invention is not limited to such configurations. For example, rigid container in conjunction with a motorized or manual pump mechanism may be used. It suffices to say that the manner in which forces for causing the edible product to be ejected from the container is of no particular consequence to the inventor herein except insofar as manufacturing cost, simplicity and ease of use are always considerations to be borne in mind.

Figure 2:
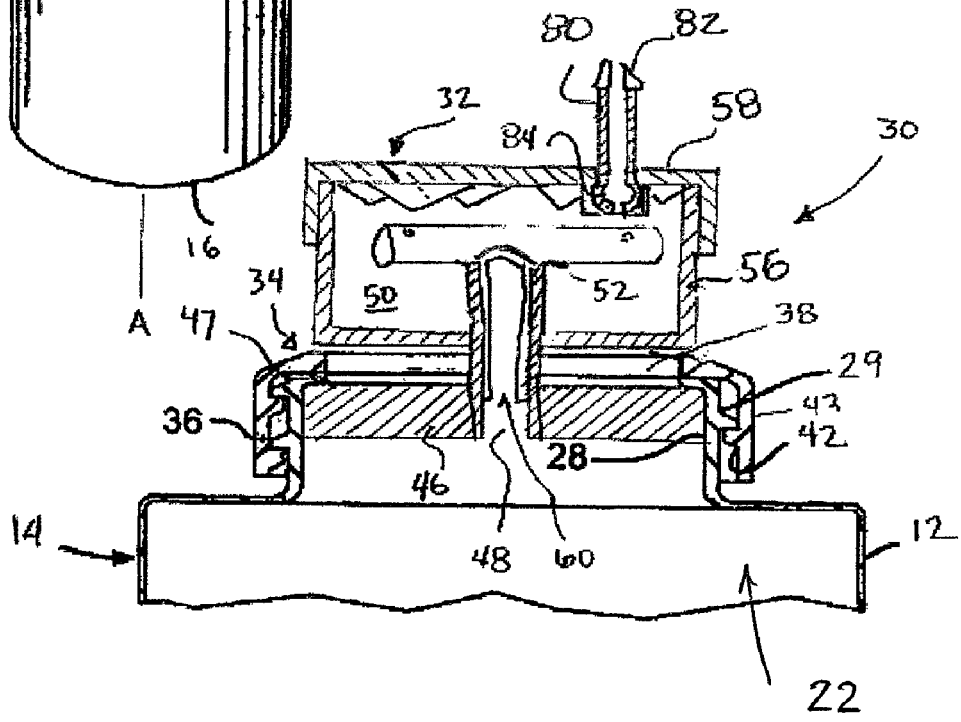
FIG. 2 is a partial, side elevation view, in cross section, depicting the internal construction of an illustrative embodiment of a rotatable discharge assembly.

Turning now to FIG. 1, an illustrative embodiment of a viscous material dispensing system 10 in accordance with the present invention is depicted. The depicted squeeze bottle embodiment includes an axially extending container 12 having an elongated cylindrical side wall 14 extending axially along axis of extension A-A. A base 16 is disposed at the one axial end of the side wall 14 that seals the bottom of the container 12. A neck 28 (FIG. 2) is integrally connected to the axially upper end of the container 12, and is defined by a reduced diameter compared to that of side wall 14. Neck 28 includes a threaded outer surface 29 (FIG. 2). An internal void or chamber 22 is thus collectively defined by side wall 14 and base 16 for housing a volume of flowable liquid material. Examples of such flowable liquid material include a spin-art paint solution, as is employed in connection with a spin-art amusement device realization of the present invention, a condiment such as ketchup, mustard, mayonnaise, relish, or the like, or any other liquid or granular material that may be poured into the neck 28 of container 12.

Container 12 can be made of a transparent or translucent plastic such as polypropylene or polyethylene to enable the user to gauge the amount and type of material in the container to determine when the container 12 is to be refilled (or discarded, as the case may be). Alternatively, the plastic may be color coded to identify the type of material. The plastic is also preferably resilient so as to enable the user to squeeze the container 12 and thus provide an internal pressure suitable to force a directed stream of material out of the container and towards a desired substrate. As noted previously, it should be understood that other means for urging the material toward a discharge opening may be employed.

With reference to both FIGS. 1 and 2, it will be seen that a discharge assembly 30 is removably connected to the neck 28, and includes a first section indicated generally at 32, and a second section indicated generally at 34. Second section 34 is adapted for fixed connection to container 12 and, to that end, includes a cylindrical flange 36 that extends axially inwardly from the radially outer edge of a substantially radially extending plate 38. The inner surface 42 of flange 36 is threaded and is configured to be removably connected to the container 12 by the threaded outer surface of neck 28 once the container 12 has been filled with the desired material. The outer surface 43 of flange 36 is preferably textured to enable a user to easily grip discharge assembly 30 for attaching the same to, and removing the same from, container 12. As best seen in FIG. 2, second section further includes a first conduit assembly indicated generally at reference number 46. The axially upper surface 47 of first conduit assembly 46 is seated on the axially lower surface of plate 38 and defines a central flow conduit 48 dimensioned and arranged to receive and transport the flowable liquid material into the first section 32, as will now be described in greater detail.

Unlike second section 34, which is adapted to be fixed, i.e., secured to container 12, first section 32 of discharge assembly 30 is dimensioned and arranged to rotate relative to container 12. First section 32 is also referred to as a discharge assembly section 32 and produces a helical deposit effect in a variety of ways. By way of illustrative example, an illustrative discharge assembly constructed in accordance with motorized embodiments of the invention may include a motorized drive assembly (not shown) responsive to depression of a trigger or, alternatively, to actuation of an on/off selector switch, and drivingly engageable with appropriate gearing coupled to first section 32

Figure 3A:
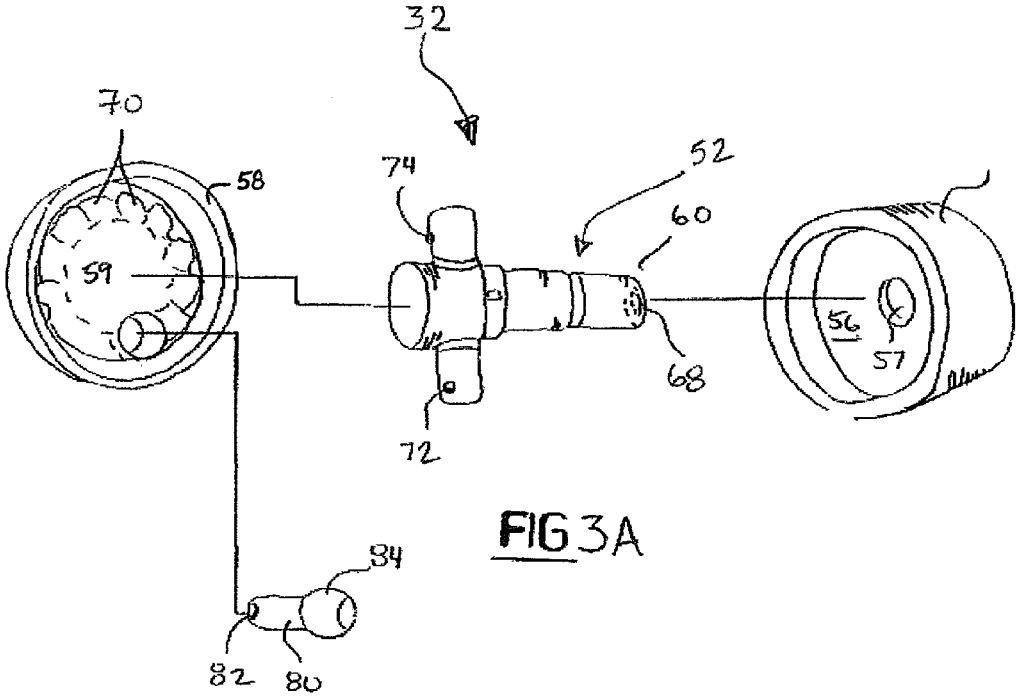
FIG. 3A is broken apart, perspective view depicting the internal construction of an exemplary, rotating discharge assembly for use in realizing the illustrative embodiment of FIG. 2.
Figure 3B:
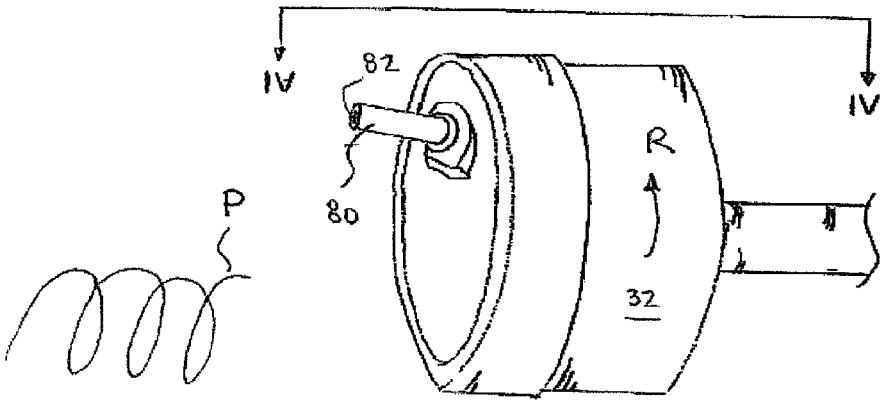
FIG. 3B is a perspective view depicting final assembly of the exemplary rotating nozzle assembly of FIG. 3A.

In accordance with an especially preferred embodiment of the present invention, however, the force for discharge assembly section 32 is provided via the pressurized material traversing flow conduit 48. An exemplary structure adapted to utilize this force is depicted in FIGS. 2-3B and will now be described in detail. As seen in FIG. 2, first section 32 of discharge assembly 30 comprises a first half 56 and a second half 58 which, when assembled into the configuration shown in FIGS. 3A and 3B, define an interior cavity 50 (FIGS. 2 and 4) within which is disposed a flow diverter assembly indicated generally at 52.

With reference to both FIGS. 2 and 3A, it will be seen that flow diverter assembly 52 has a proximal end 60 dimensioned and arranged to be received and retained within conduit 48 of first conduit assembly. First conduit assembly 46 and flow diverter assembly 52 are fastened together in a conventional manner such, for example, as by a suitable adhesive. Accordingly, fluid diverter assembly 52 is not a moving part but, rather, is stationary despite being disposed within interior cavity 50. Fluid material exiting the discharge orifice 48 of first conduit assembly 46 enters an inlet 68 (FIG. 3A) defined at the proximal end 60 of flow diverter assembly 52. The center of first half 56 defines an axial opening 57 through which proximal end 60 is inserted. To prevent fluid material from leaking out of interior cavity 50, O-rings or other suitable gaskets (not shown) may be utilized in a conventional manner at the interface between moving parts and bushings may be incorporated as required to prevent axial movement of rotatable first section 32 relative to the second section 34 of discharge assembly 30.

In any event, and with particular reference to FIG. 3A, it will be seen that defined within the interior axial surface 59 of second half 58 are a plurality of vanes 70. As best seen in FIG. 3A liquid entering inlet opening 68 of flow diverter assembly 52 exits via a pair of exit openings indicated generally at 72 and 74. As will be readily appreciated by those skilled in the art, exit opening 72 and 74 are dimensioned and arranged so as to cause corresponding jets of liquid to impinge upon the surfaces of vanes 70, thereby initiating rotation of first section 32 relating to second section 34.

With particular reference to FIG. 3B, it will be seen that spinning of first section 32 in the direction of arrow R and about a rotational axis parallel to axis A-A of container 12 (FIG. 1), enables the contents of container 12 to be deposited along a helical deposit path while the container is held stationary or moved linearly. As used herein, the phrase helical deposit path is intended to encompass any path having a curvilinear component which is transverse to the direction in which the container, as container 12, is moved. An illustrative deposit pattern is indicated generally at P in FIG. 3B.

In any event, and with continued reference to FIGS. 1-3B, it will seen that discharge assembly 30 further includes a pivotably movable nozzle member 80 having a distal section defining a nozzle orifice 82 and having a substantially spherical proximal section 84 retained in fluid communication with interior cavity 50 of first section 32. Such a structure is advantageous in that it gives the user a high degree of flexibility and creativity. As will be readily appreciated by those skilled in the art, the closer the nozzle tip is to the center of rotation, the smaller the arc covered during each period of rotation. Of course, if such flexibility is not a design constraint, then it is of course possible to integrally form a nozzle member directly as part of second section 32. In that regard, it is contemplated that a nozzle member so constructed may be configured to extend forward at any desired angle relative to the axis of rotation of rotatable discharge assembly 30. It is further contemplated that multiple nozzle members may be included so as to cause to simultaneous streams to be helically wound about the axis of nozzle assembly rotation.

Finally, although the nozzle member 80 depicted in the illustrative embodiment is shown in a position that is offset relative to the axis of rotation of first section 32, it should be emphasized that by placing the nozzle member 80 at the center of rotation would allow a dual mode of dispensing. That is, by aligning the discharge opening 82 so that it is coaxial with the axis or rotation (axis A-A in FIG. 1), it is possible to obtain a rectilinear mode of operation in which linear movement of the system 10 yields a rectilinear deposit path notwithstanding rotation of first section 32. Conversely, pivoting nozzle member out of axial alignment with the rotational axis of first section 32 will produce the helical/curvilinear deposit path as previously described.

From the foregoing, it will be understood that when the user inverts the container 12 containing a flowable liquid material and directs the nozzle 80 at a flowable product and applies a squeezing pressure to container 12, the material will be forced through outlet channel 82 and dispensed as a spiral or straight line stream.

While the particular flowable product dispensing system and methods as herein shown and described in detail are fully capable of attaining the above-described objects of the invention, it is to be understood that they are merely illustrative embodiments of the present invention and are thus merely representative of the subject matter which is broadly contemplated by the present invention, that the scope of the present invention fully encompasses other embodiments which may become obvious to those skilled in the art, and that the scope of the present invention is accordingly to be limited by nothing other than the appended claims.

What is claimed is:

1. A discharge assembly for dispensing a flowable material disposed within an interior chamber of an axially extending container, the discharge assembly comprising:

a first section defining an interior cavity, said first section further defining an inlet opening defined in a part of said first section and dimensioned and arranged to establish fluid communication between the interior cavity and the interior chamber, and an outlet opening defined in said first section and dimensioned and arranged to allow material flowing under pressure to exit said interior cavity as a stream as said first section moves; and a second section securable to the container and defining an axial conduit for transfer of flowing material from within said interior chamber to within said interior cavity;

the part of said first section defining said inlet opening being rotatably mounted on one of said axial conduit and an axial extension connected to said axial conduit, said first section being dimensioned and arranged to rotate about said one of said axial conduit and said axial extension connected to said axial conduit, relative to the second section and to a container to which said second section is secured, while receiving flowing material from the interior chamber and to discharge received material from the outlet opening as the first section moves to form a discharge pattern.

2. The discharge assembly of claim 1, further comprising a plurality of vanes disposed within said interior cavity, said vanes being dimensioned and arranged to convert energy imparted by flowing material impinging thereon into forces driving one of reciprocal and rotary motion of said first section relative to said second.

3. The discharge assembly of claim 2, wherein said discharge assembly further includes a pivotably movable nozzle member having a distal section defining a nozzle orifice and having a substantially spherical proximal section retained in fluid communication with said outlet opening, whereby a user can control at least one of a diameter, direction, motion pattern and a pitch of said discharge pattern.

4. An amusement device comprising:

a tray for receiving and retaining a substrate;

an axially extending container defining a container opening and an interior chamber for receiving and storing a viscous flowable product;

a discharge assembly as recited in claim 1 coupled to said container, said discharge assembly being dimensioned and arranged to move, relative to the container, while receiving viscous flowable product from the interior chamber and to discharge received viscous flowable product as it moves to form a discharge pattern on a target surface; and a fluid transfer system operative to develop forces for causing the viscous flowable product disposed within the interior chamber to flow through said container opening and out of the discharge assembly, whereby relative movement of said discharge assembly and said tray during operation of said fluid transfer system produces the discharge patterns on the target surface.

5. The device of claim 4, wherein said container is a squeeze bottle and wherein said fluid transfer system comprises a deformable sidewall of said container.

6. The device of claim 4, wherein said discharge assembly further includes a plurality of vanes disposed within said interior cavity, said vanes being dimensioned and arranged to convert energy imparted by flowing flowable product impinging thereon into forces driving one of reciprocal and rotary motion of said first section.

7. The device of claim 4, wherein said discharge assembly further includes a pivotably movable nozzle member having a distal section defining a nozzle orifice and having a substantially spherical proximal section retained in fluid communication with said outlet opening, whereby a user can select at least one of a desired diameter, direction, motion pattern and a desired pitch of said discharge pattern.

8. The device of claim 4, wherein said container includes a threaded exterior region proximate said container fill opening, said discharge assembly further including a second section threadably securable to the container and defining an axial conduit for transfer of flowing flowable product from within said interior chamber to within said interior cavity.

9. The device of claim 4, wherein said discharge assembly is manipulable into a locked configuration relative to the container such that said discharge assembly remains stationary while flowable product is discharged from within the interior chamber.

10. The apparatus of claim 6, wherein said discharge assembly further includes a pivotably movable nozzle member having a distal section defining a nozzle orifice and having a substantially spherical proximal section retained in fluid communication with said outlet opening, whereby a user can control at least one of a diameter, direction, motion pattern and a pitch of said discharge pattern.

11. The device of claim 6, wherein said discharge assembly further includes a flow director assembly adapted to receive viscous flowable product from the interior chamber and to change a direction of flow so as to cause arriving flowable product to impinge upon said vanes.

12. A method of dispensing a flowable product from a container having a discharge assembly, the discharge assembly including a first section defining an interior cavity, said first section further defining an inlet opening defined in said first section and dimensioned and arranged to establish fluid communication between the interior cavity and an interior chamber of the container, and an outlet opening defined in said first section and dimensioned and arranged to allow material flowing under pressure to exit said interior cavity as a stream as said first section moves, and the discharge assembly further including a second section securable to the container and defining an axial conduit for transfer of flowing material from within said interior chamber to within said interior cavity, the part of said first section defining said inlet opening being rotatably mounted on one of the axial conduit and an axial extension connected to the axial conduit, the first section being dimensioned and arranged to rotate about the one of the axial conduit and the axial extension connected to the axial conduit, said method comprising the steps of:

initiating a flow of flowable material from a chamber of a container containing a flowable material toward the discharge assembly;

rotating the discharge assembly, relative to the container, while the material is being discharged via the exit orifice; and positioning the exit orifice relative to a target, during said moving step, to thereby direct a discharge pattern at the target.

13. The method of claim 12, wherein the nozzle assembly includes vanes and said step of rotating comprises causing the viscous material under pressure to impinge upon the vanes of the nozzle assembly.

14. The method of claim 12, wherein the container is a squeeze bottle, said method further including a step of squeezing the container to thereby cause the material to flow from the chamber into the discharge assembly.

15. The method of claim 12, wherein said flowable product is a spin-art paints solution.

16. The method of claim 12, wherein said target is a stationary piece of paper.

* * * * *